US005193800A

United States Patent [19]

Kashiwabara

[11] Patent Number: 5,193,800

[45] Date of Patent: Mar. 16, 1993

[54] APPARATUS FOR CONVEYING PAPER IN A PRINTER

[75] Inventor: Kazutoshi Kashiwabara, Suwa, Japan

[73] Assignee: Seiko Epson Corporation, Tokyo, Japan

[21] Appl. No.: 864,779

[22] Filed: Apr. 7, 1992

[30] Foreign Application Priority Data

Apr. 8, 1991 [JP] Japan ..... 3-75086

[51] Int. Cl.[5] ..... B65H 5/06

[52] U.S. Cl. ..... 271/272; 226/175; 226/191; 271/902; 400/641

[58] Field of Search ..... 271/272, 273, 902; 226/175, 191; 400/641, 636

[56] References Cited

U.S. PATENT DOCUMENTS 1,085,908 2/1914 Hoe ..... 226/175
2,341,636 2/1944 Luehrs ..... 226/175

FOREIGN PATENT DOCUMENTS 64-30251 2/1989 Japan .
64-30252 2/1989 Japan .

OTHER PUBLICATIONS

Translation of 64-30251 filed Dec. 17, 1992.

*Primary Examiner*—Richard A. Schacher
*Attorney, Agent, or Firm*—Blum Kaplan

[57] ABSTRACT

An apparatus for conveying paper in a printer adapted to convey cut-sheet and fan-fold paper bi-directionally in a paper path. The apparatus includes a pair of paper conveying rollers positioned downstream of a print head and a pair of paper conveying rollers positioned upstream of the print head. At least one roller of one of the paper conveying roller pair has projections circumferentially extending away from the roller. The projections can be pressed against the roller to reduce the diameter and speed of the roller relative to its speed and diameter before compression to convey the paper in a first direction while preventing the formation of slack across the paper. In addition, the projections can be extended away from the roller to increase the diameter and speed of the roller relative to its speed and diameter before extension to convey the paper in a second direction while preventing the formation of slack across the paper.

22 Claims, 6 Drawing Sheets

FIG. 6
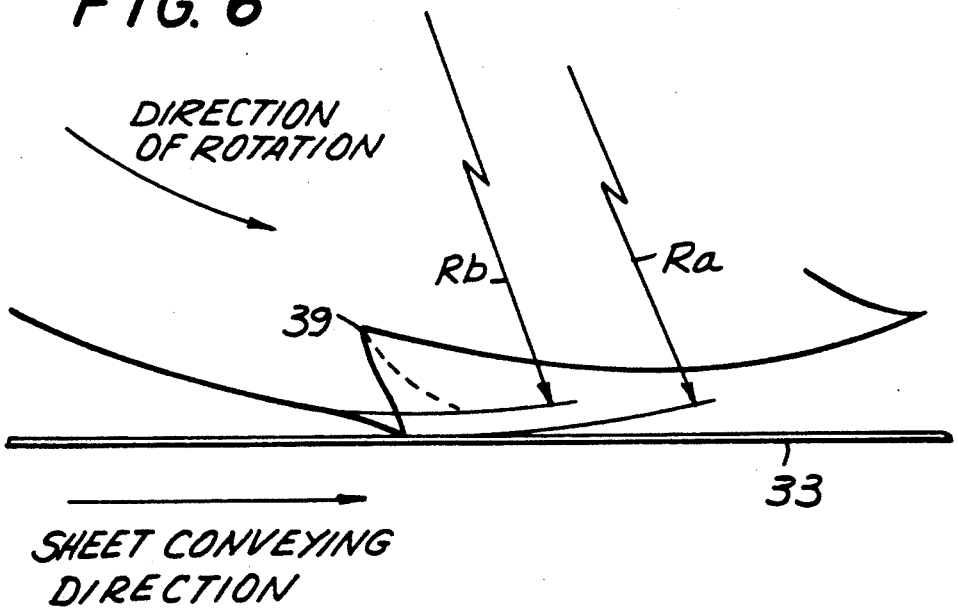
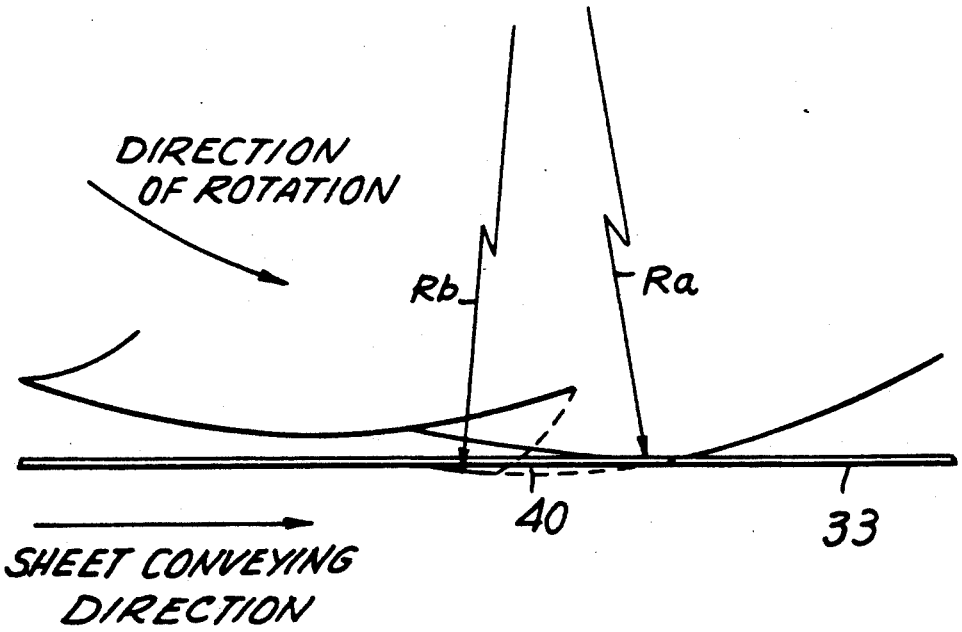
FIG. 7

APPARATUS FOR CONVEYING PAPER IN A PRINTER

BACKGROUND OF THE INVENTION

The present invention is directed generally to an apparatus for conveying cut or fan-fold paper in a printer, and, in particular, to a paper feeder which prevents slack from developing in the paper as it is conveyed in both the reverse and forward directions through the printer.

A conventional apparatus for conveying cut paper in a printer is shown in FIG. 1. The printer includes a print head 1. Cut paper 13 is fed downstream in the direction of arrow A to print head 1. A pair of paper conveying rollers 14 are positioned upstream of print head 1 and a platen 12. Cut paper 13 is fed by a pair of paper discharging rollers 11 positioned downstream of print head 1 and platen 12 in conjunction with paper conveying rollers 14. Paper discharging rollers 11 rotate at a faster speed than paper conveying rollers 14 to take up any slack that occurs across cut paper 13.

Another conventional paper feeding apparatus is shown in FIG. 2 for feeding fan-fold paper in a printer. The device includes a print head 2 and an opposed platen 22. A push tractor 24 feeds fan-fold paper 23 downstream in the direction of arrow A (the forward conveying direction) to print head 2 and platen 22. A pair of sheet conveying rollers 25 are positioned upstream of print head 2. Fan-fold paper 23 is conveyed by sheet discharging rollers 21 in cooperation with paper conveying rollers 25.

Paper discharging rollers 21 rotate at a greater peripheral speed than paper conveying rollers 25 so that fan-fold paper 23 is stretched tight between paper discharging rollers 21 and paper conveying rollers 25 and between tractor 24 and paper conveying rollers 25.

The above-described conventional paper feeders for printers suffer from the following difficulties when the printing sheet is conveyed in the reverse direction (in the direction of arrow B). Referring specifically to FIG. 1, when cut paper 13 is conveyed by sheet discharging rollers 11, platen 12 and paper conveying rollers 14 in the direction of arrow B (the reverse conveying direction), slack occurs on cut paper 13 between paper discharging rollers 11 and paper conveying rollers 14 because the peripheral speed of paper discharging rollers 11 is greater than that of paper conveying rollers 14. The resultant slack causes degradation in printing accuracy.

In the embodiment of FIG. 2, tractor 24, platen 22, paper conveying rollers 25 and paper discharging rollers 21 convey fan-fold paper 23 in the printer. As described above with respect to FIG. 1, when conveying fan-fold paper 23 in the reverse direction, slack develops on fan-fold paper 23 between paper discharging rollers 21 and paper conveying rollers 25 so that fan-fold paper 23 may be caught in the printer. Furthermore, since the peripheral speed of paper conveying rollers 21 is greater than that of paper conveying rollers 25, the slack causes fan-fold paper 13 to jam and separate from tractor 24. In addition, the back-out capacity is lowered.

Accordingly, it is desired to provide an apparatus for conveying paper which overcomes the disadvantages of the prior art devices described above by providing a conveying mechanism which eliminates slack during conveying in the reverse direction by applying tension to the paper when conveyed in either a forward or reverse direction.

SUMMARY OF THE INVENTION

Generally speaking, in accordance with the present invention, an apparatus for conveying paper within a printer adapted to convey both fan-fold and cut paper in reverse and forward directions is provided. The apparatus includes a print head for printing on paper. A tractor may be positioned downstream from the print head in the paper feeding direction to convey fan-fold paper. The paper is conveyed by a pair of conveying rollers and a pair of discharging rollers. The paper can be conveyed in both a forward conveying direction and a reverse conveying direction. The conveying rollers include projections or teeth such as burrs which extend circumferentially in the reverse conveying direction. The discharging rollers include burrs which extend circumferentially in the forward conveying direction. When the printing paper is conveyed, the diameter of the rollers having projections extending in the paper conveying direction increases because the projections extend away from the roller. The diameter of the roller having projections opposite the paper conveying direction decreases because the projections are compressed against the roller.

Hence, when the paper is conveyed in a forward conveying direction, the peripheral speed of the rollers located downstream in the actual paper conveying direction is increased, thus applying tension to the paper at all times. When the paper is conveyed in the reverse conveying direction, the diameter of the rollers having projections extending in the reverse conveying direction substantially becomes larger and the peripheral speed of the rollers upstream becomes increased. Thus, the paper can be conveyed in both directions with high improved stability and accuracy.

Accordingly, it is an object of the present invention to provide an improved apparatus for conveying both fan-fold and cut paper in a printer.

Another object of the present invention is to provide an apparatus for effectively conveying fan-fold and cut paper, in both forward and reverse directions, in a printer.

Yet another object of the present invention is to provide an apparatus for conveying cut and fan-fold paper which eliminates slack when feeding the paper in one of a forward or reverse direction.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For further understanding of the invention, reference is had to the following description, taken in connection with the accompanying drawings, in which:

FIG. 6 is a diagrammatic view of a roller having burrs constructed in accordance with the present invention wherein the burrs extend in the paper conveying direction; and FIG. 7 is a diagrammatic view of a roller having burrs constructed in accordance with the present invention wherein the burrs extend in the direction opposite the paper conveying direction.

DETAILED DESCRIPTION OF THE PREFERRED EMBODIMENTS

Figure 3:
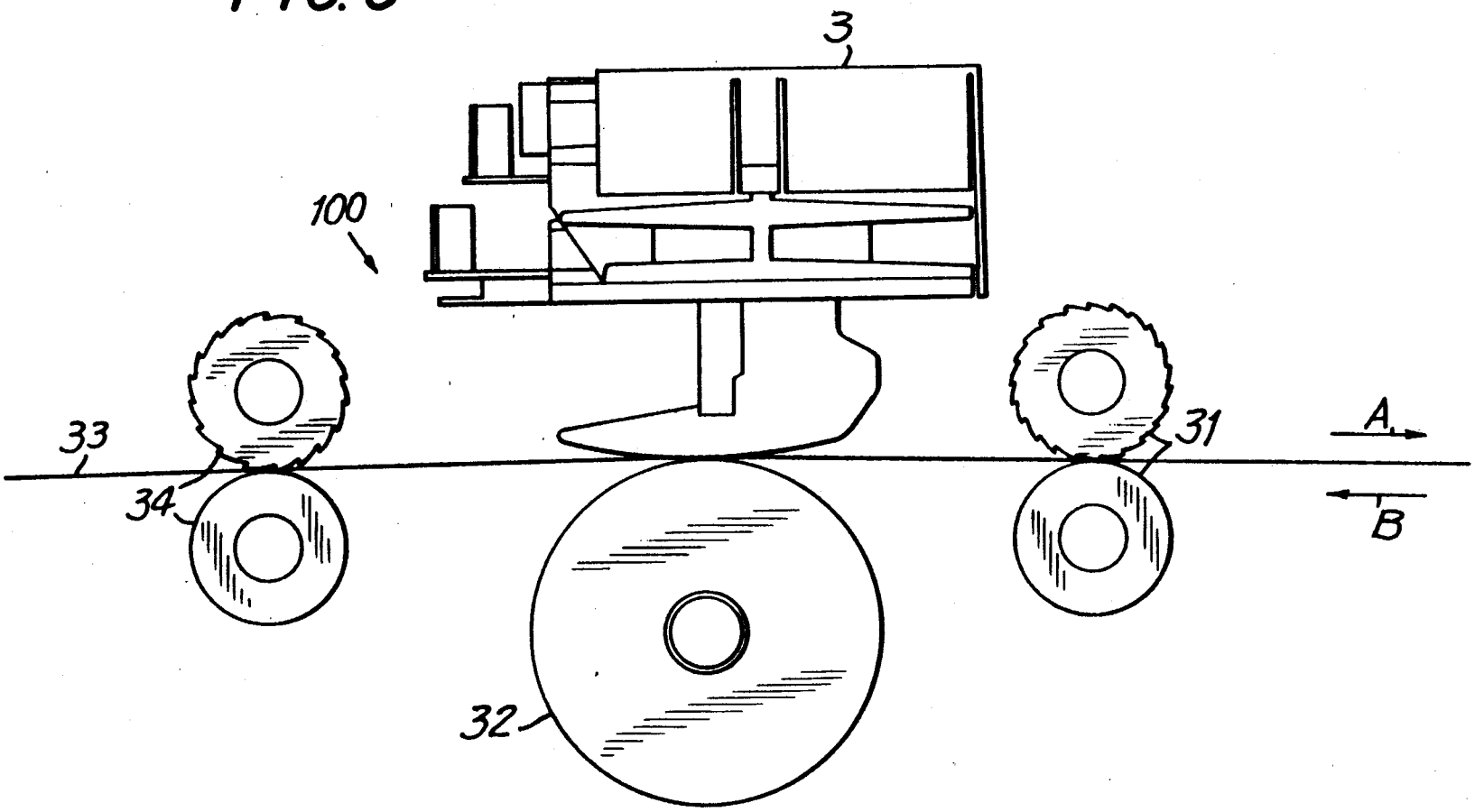
FIG. 3 is a side elevational view of an apparatus for feeding cut-sheet paper constructed in accordance with a first embodiment of the present invention.

Reference is made to FIG. 3 wherein an apparatus for conveying paper in a printer adapted to utilize cut paper, generally indicated at 100, is depicted. Apparatus 100 includes a pair of paper conveying rollers 34 positioned upstream of a print head 3 and an opposed platen 32 and a pair of opposed paper discharging rollers 31 positioned downstream of print head 3 and platen 32. A cut-sheet of paper 33 is conveyed by means of platen 32, papering conveying rollers 34 and paper discharging rollers 31.

Paper 33 is conveyed in the direction of arrow A (hereinafter "the forward conveying direction"). Paper discharging rollers 31 rotate at a peripheral speed greater than the peripheral speed of paper conveying rollers 34. The peripheral speed of paper conveying rollers 34 is essentially equal to a predetermined paper conveying speed. Therefore, paper discharging rollers 31 apply tension to paper 33 while slipping thereon.

Figure 5A:
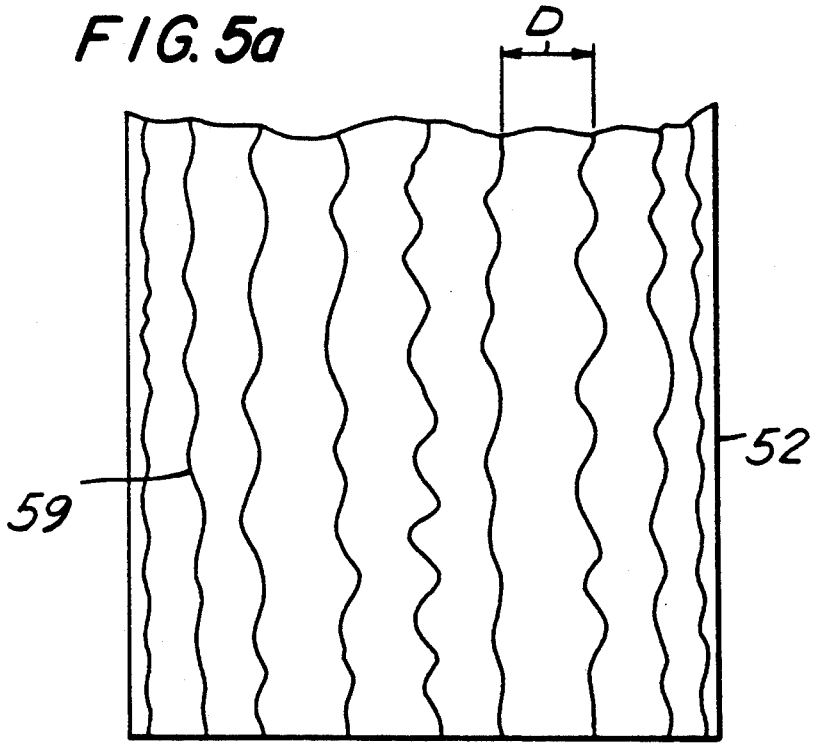
FIGS. 5(*a*) and 5(*b*) are a plan view and a sectional view, respectively, of a roller for use in an apparatus for conveying paper constructed in accordance with the present invention.
Figure 5B:
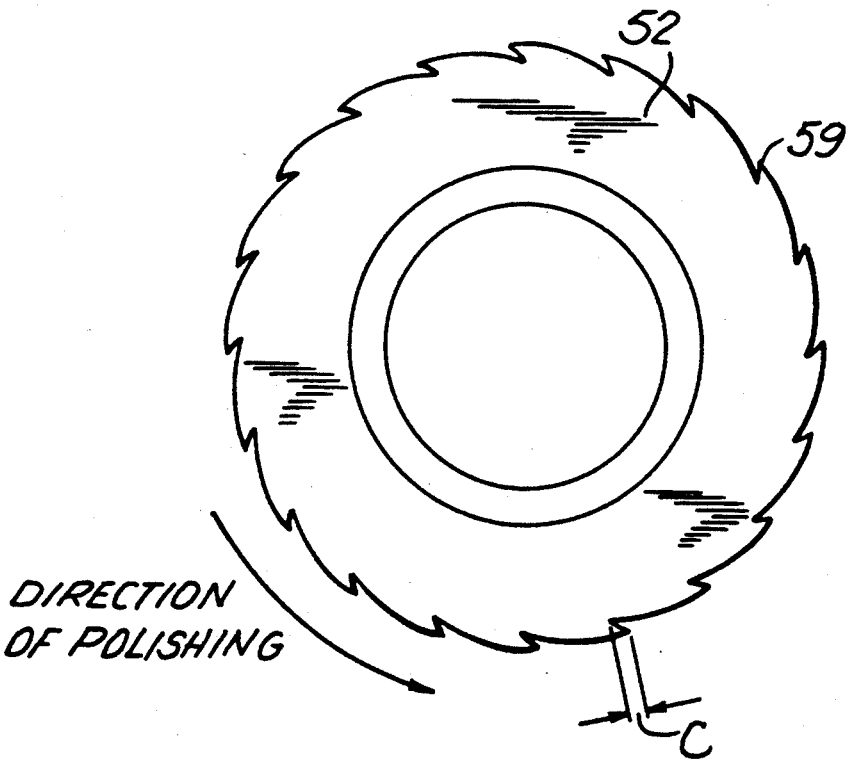
Figure 2:
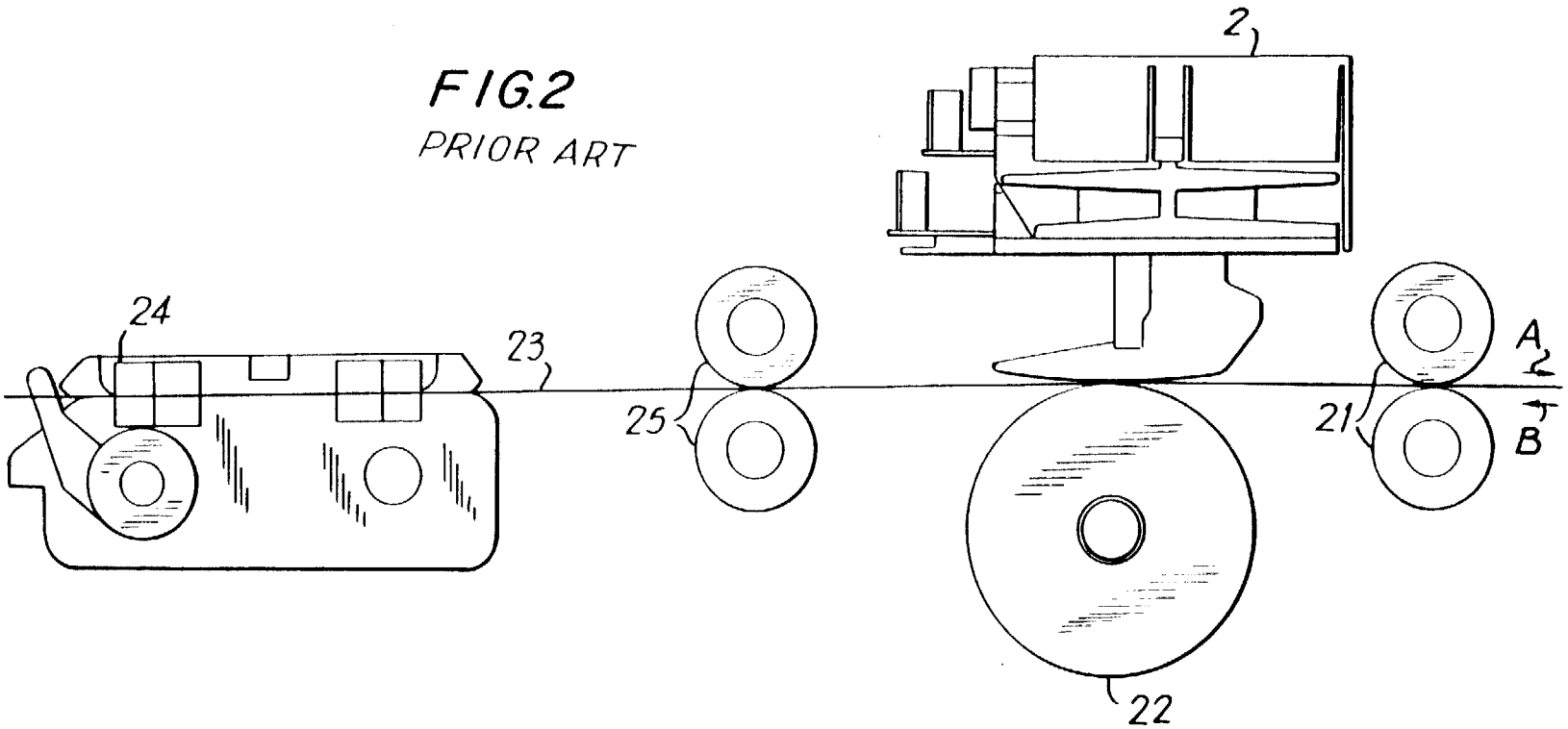
FIG.2 PRIOR ART

At least one paper conveying roller 34 and at least one paper discharging roller 31 are formed of a rubber material such as a mixture of natural rubber and synthetic resin. The rubber material is poured into a predetermined mold to form a hollow cylinder 52 (FIG. 5(*b*)). Hollow cylinder 52 is fixedly mounted on a rotary shaft which is set on a grinding machine. Under this condition, the surface of the hollow cylinder is ground with a rotating cylindrical grinding stone, so that projections or teeth such as burrs 59 are formed on the surface as shown in FIGS. 5(*a*) and 5(*b*).

When the rubber roller grinding direction is the same as the forward conveying direction, as shown in FIG. 6, burrs 39 are raised by the force of rotation of the roller, and therefore the actual radius Ra is larger than the apparent radius Rb. Hence, when the roller is rotated, the actual peripheral speed increases. On the other hand, when the rubber roller grinding direction is opposite the forward conveying direction, as shown in FIG. 7, burrs 40 are pushed radially inward the roller, so that the actual radius Ra is smaller than the apparent radius Rb. Hence, when the roller is rotated, the actual peripheral speed decreases.

In actual practice, the grinding direction of at least one of paper conveying rollers 34 is opposite to the forward conveying direction. Burrs 39 formed on sheet conveying rollers 34 about 16.17 mm in diameter are of the order of about 0.5 mm in length C as shown in FIG. 5(*b*). The substantial radius is about 0.3% smaller than the apparent radius and, as previously mentioned, the burrs are pushed inwardly of the roller. The distance D between adjacent burrs is preferably in a range of from about 0.8 mm to about 1.5 mm.

Projections or teeth such as burrs 40 in at least one of discharging rollers 11 are ground in the forward conveying direction. Burrs 40 formed on discharging rollers 11 preferably about 16.23 mm in diameter are of the order of about 0.5 mm in length C. The substantial radius is larger by about 0.3% than the apparent radius because burrs 40 are raised. Hence, when cut paper 13 is conveyed in the forward conveying direction, with at least one paper conveying roller 34 ground in the reverse conveying direction and with at least one paper discharging roller 11 ground in the forward conveying direction, the peripheral speed of paper conveying rollers 34 is slightly lower than the apparent peripheral speed, whereas the substantial peripheral speed of paper discharging rollers 11 is slightly higher than the apparent peripheral speed. Hence, tension acts on paper 33 thereby preventing slack. This improves the printing accuracy, decreases the printing sound, and prevents the paper from being caught in the printer.

When paper 33 is conveyed in the reverse direction, the peripheral speed of paper conveying roller 34 is greater than the apparent peripheral speed, whereas the peripheral speed of the paper discharging roller 31 is slightly higher than the apparent peripheral speed. The diameter of sheet discharging roller 31 can be greater than the diameter of sheet conveying roller 34. Therefore, the difference in speed between sheet discharging roller 34 and sheet conveying roller 31 is less than when paper 33 is conveyed in the forward direction. Hence, slack is reduced in paper 33 which improves the back-feed printing accuracy.

Figure 4:
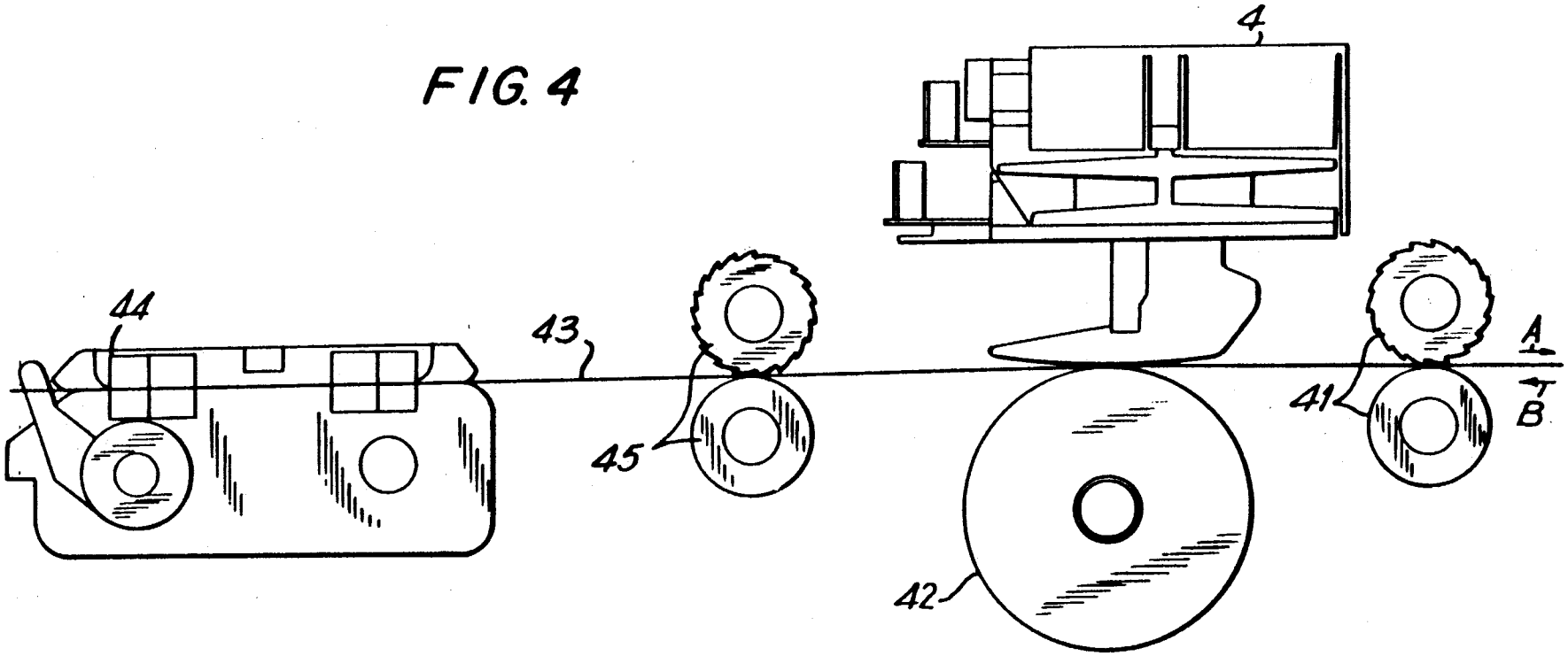
FIG. 4 is a side elevational view of an apparatus for feeding fan-fold paper constructed in accordance with a second embodiment of the present invention.

Referring specifically to FIG. 4, a second embodiment in accordance with the invention is illustrated. More specifically, this apparatus feeds fan-fold paper. The apparatus includes a pair of paper conveying rollers 45 provided between a tractor 44 and a platen 42. A pair of paper discharging rollers 41 are positioned downstream of a print head 4 and platen 42. Fan-fold paper 43 is conveyed by means of tractor 44, platen 42, paper conveying rollers 45 and paper discharging rollers 41.

Similarly, as in the above-mentioned first embodiment, at least one of paper conveying rollers 45 is ground in the reverse conveying direction, whereas at least one of paper discharging rollers 41 is ground in the paper-forwarding conveying direction.

Paper 43 can be conveyed in the directions of arrows A and B. Paper conveying rollers 45 are rotated at a peripheral speed and convey the paper at the same rate as tractor 44. Paper discharging rollers 41 are rotated at a peripheral speed greater than that of paper conveying rollers 45.

When paper 43 is conveyed in the forward direction, greater tension is applied to paper 43 by paper discharging rollers 45, preventing the slack from forming across paper 43. This improves the printing accuracy and decreases the printing sound. In the case when the paper is conveyed in the reverse conveying direction, the paper is also prevented from being slackened, so that the back-out capacity is improved.

While two embodiments of the invention have been described with reference to the impact dot printer, it should be noted that the invention is not limited thereto. The invention can be widely applied to printing devices such as page printers, thermal printers and ink jet printers in which paper conveying rollers or a tractor are arranged to convey the paper both in forward and in reverse directions.

By providing an apparatus for conveying paper with at least one paper discharging roller ground in the forward conveying direction and at least one paper conveying roller ground in the reverse conveying direction, slack can be prevented from occurring across a paper when the paper is conveyed in either of a forward or reverse direction. This effectively improves the printing accuracy, decreases the printing noise, prevents the printing paper from being caught in the printer, improves the back-out capacity and the back-feed printing accuracy of the printer.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for conveying paper in a printer along a paper path past a print head in a first direction and in a second direction opposite to the first direction, comprising first conveying means positioned upstream of the print head having a predetermined diameter for selectively conveying said paper along said print path and second conveying means positioned downstream of said print head having a predetermined diameter for selectively conveying said paper along the print path, said at least first conveying means having a diameter and including means for selectively changing the diameter of said first conveying means in response to whether said paper is being conveyed in the first direction or the second direction.

2. The apparatus for conveying paper of claim 1, wherein said paper is fan-fold paper and further including tractor means for selectively conveying said fan-fold paper in the first and second directions.

3. The apparatus for conveying paper of claim 1, wherein said first conveying means includes a first opposed roller pair supported on said printer upstream of said print head, and said second conveying means includes a second opposed roller pair supported on said printer downstream of said print head, said first and second roller pairs cooperating with each other to convey said paper along said paper path.

4. The apparatus for conveying paper of claim 3, wherein the diameter of one of said rollers in said first roller pair when said paper is conveyed in the first direction is smaller than the diameter of said one roller when said paper is conveyed in the second direction.

5. The apparatus for conveying paper of claim 1, wherein said means for selectively changing the diameter of said first conveying means includes first projections formed on said first conveying means.

6. The apparatus for conveying paper of claim 5, wherein said first projections are deformable.

7. The apparatus for conveying paper of claim 5, wherein said first projections are in one of a first position wherein said first projections extend away from said first conveying means and a second position wherein said first projections are forced inwardly against said first conveying means in response to said paper being conveyed in one of said first and the second directions.

8. The apparatus for conveying paper of claim 5, wherein said first projections are compressed against said first conveying means when said paper is conveyed in the first direction.

9. The apparatus for conveying paper of claim 5, wherein said first projections extend away from said first conveying means when said paper is conveyed in the second direction.

10. The apparatus for conveying paper of claim 1, further including means for changing the diameter of said second conveying means in response to said direction said paper is conveyed along said paper path.

11. The apparatus for conveying paper of claim 10, wherein said paper is fan-fold paper and further including tractor means for conveying said fan-fold paper in said first and the second directions.

12. The apparatus for conveying paper of claim 5, wherein said means for selectively changing the diameter of said second conveying means includes second projections formed on the second conveying means.

13. The apparatus for conveying paper of claim 12, wherein said second projections formed on said second conveying means are deformable.

14. The apparatus for conveying paper of claim 12, wherein said second projections are in one of a first position wherein said projections extend away from said second conveying means in response to said paper being conveyed in the first direction and a second position wherein said second projections are compressed against said second conveying means in response to said paper being conveyed in the second direction.

15. The apparatus for conveying paper of claim 4, wherein said one roller has first projections extending circumferentially from said roller.

16. The apparatus for conveying paper of claim 15, wherein said first projections are pressed against said one roller by said other roller of said first roller pair to reduce the diameter of said one roller when said paper is conveyed in the first direction.

17. The apparatus for conveying paper of claim 15, wherein said first projections are extended away from said one roller by said other roller of said first roller pair to increase the diameter of said one roller when said paper is conveyed in the second direction.

18. The apparatus for conveying paper of claim 4, wherein the diameter of one of said rollers in said second roller pair when said paper is conveyed in the first direction is larger than the diameter of said one second roller when said paper is conveyed in said second direction.

19. The apparatus for conveying paper of claim 16, wherein said second roller pair has first and second opposed rollers, said first roller in said second roller pair having second projections extending circumferentially from said first roller of said second roller pair.

20. The apparatus for conveying paper of claim 17, wherein said second roller pair has first and second opposed rollers, said first roller in said second roller pair having second projections extending circumferentially from said first roller of said second roller pair.

21. The apparatus for conveying paper of claim 19, wherein said second projections are extended away from said first roller of said second roller pair to increase the diameter of said first roller of said second roller pair when said paper is conveyed in said first direction.

22. The apparatus for conveying paper of claim 20, wherein said second projections are pressed against said first roller of said second roller pair to reduce the diameter of said first roller of said second roller pair when said paper is conveyed in said second direction.

* * * * *

UNITED STATES PATENT AND TRADEMARK OFFICE

CERTIFICATE OF CORRECTION

PATENT NO. : 5,193,800

DATED : March 16, 1993

INVENTOR(S) : Kazutolshi Kashiwabara

Figure 1:
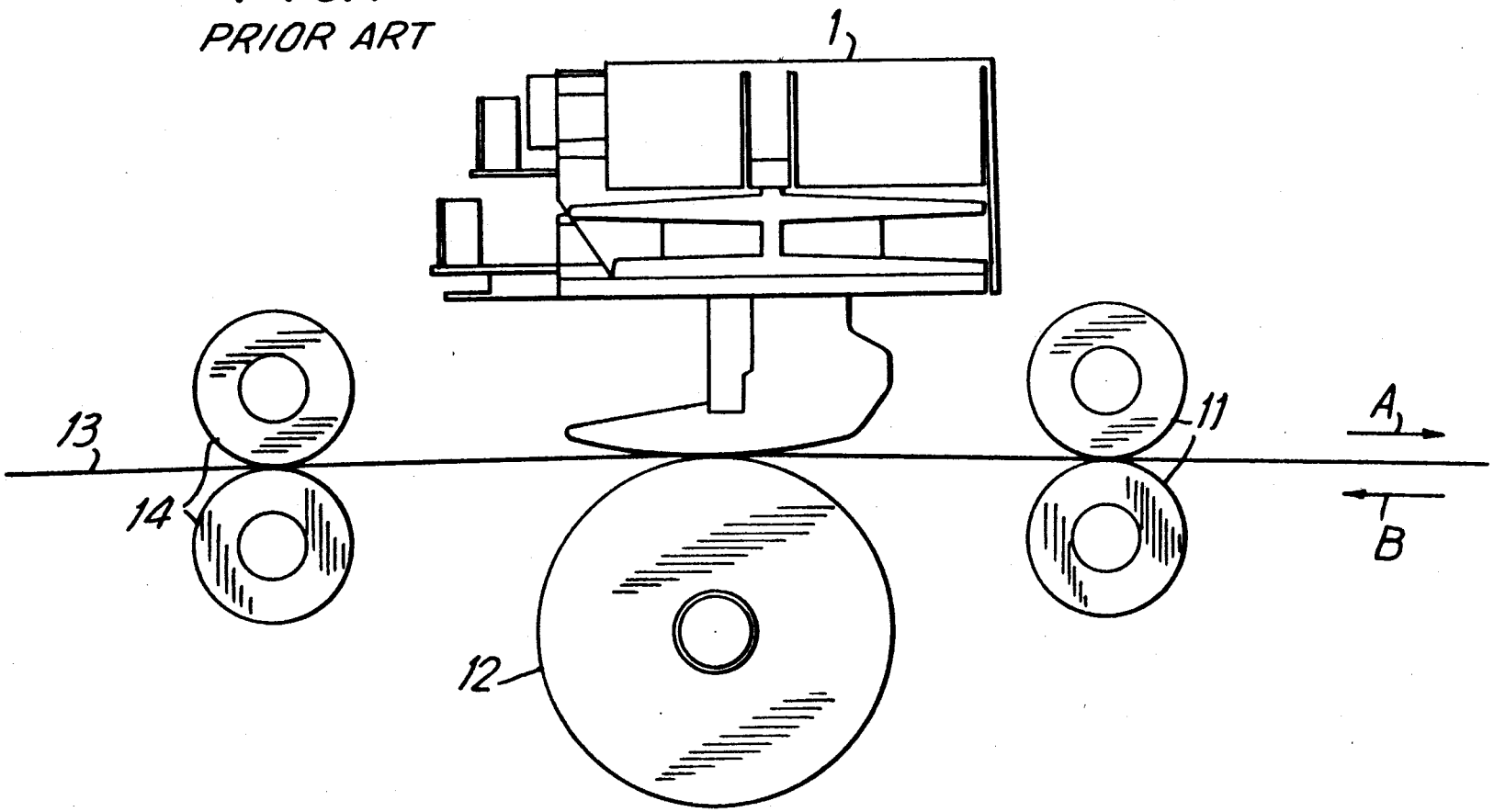
FIG. 1 PRIOR ART
FIG. 1 is a side elevational view of an apparatus for feeding cut-sheet paper constructed in accordance with the prior art.
Figure 2:
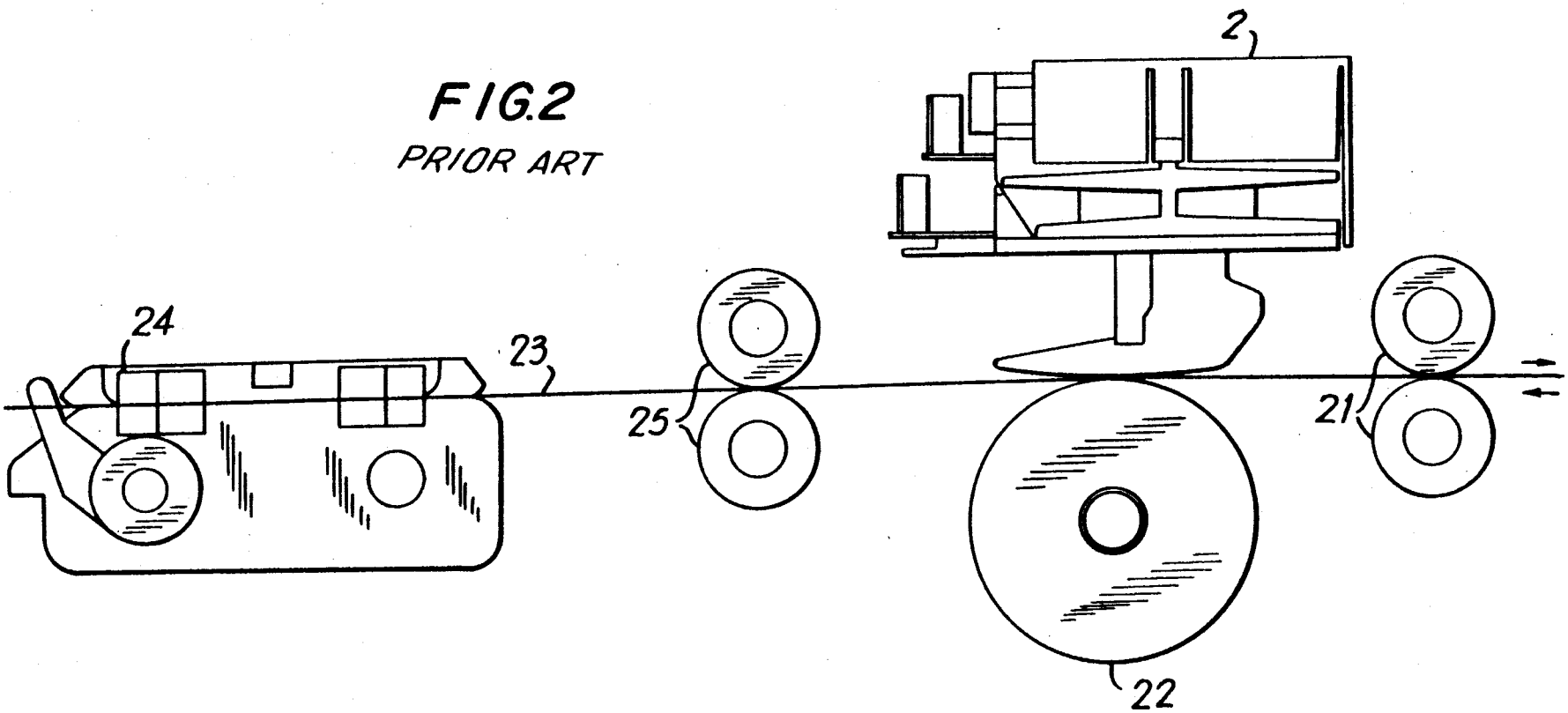
FIG.2 PRIOR ART
FIG. 2 is a side elevational view of an apparatus for feeding fan-fold paper constructed in accordance with the prior art.

It is certified that error appears in the above-indentified patent and that said Letters Patent is hereby corrected as shown below:

The drawing sheet consisting of Figure 2, should be deleted to be replaced with the drawing sheet consisting of Fig.2 as shown on the attached page.

Signed and Sealed this

Eighth Day of February, 1994

Bruce Lehman

*Attest:*

BRUCE LEHMAN

*Attesting Officer*

*Commissioner of Patents and Trademarks*